United States Patent [19]

Patel et al.

[11] Patent Number: 4,465,238

[45] Date of Patent: Aug. 14, 1984

[54] FILTER FOR HOT AIR NOZZLE

[76] Inventors: Jhina Patel; James P. Van Sweringen, both of 25000 Miles Rd., Cleveland, Ohio 44128

[21] Appl. No.: 299,468

[22] Filed: Sep. 4, 1981

[51] Int. Cl.[3] ..... B05B 1/14

[52] U.S. Cl. ..... 239/590.3; 55/385 R; 55/505

[58] Field of Search ..... 239/575, 590.3, DIG. 23; 55/385 R, 480, 498, 505, 525; 34/82

[56] References Cited

U.S. PATENT DOCUMENTS

| | | | |
|---|---|---|---|
| 2,055,864 | 9/1936 | Harsch | 239/DIG. 23 |
| 2,445,074 | 7/1948 | McCue | 34/82 X |
| 2,605,091 | 7/1952 | Socke | 239/590.3 X |
| 2,681,829 | 6/1954 | Wahlin | 239/590.3 |
| 2,744,738 | 5/1956 | Hjulian | 239/590.3 X |
| 2,778,684 | 1/1957 | Forst | 239/575 |
| 3,009,655 | 11/1961 | Palmer | 239/590.3 X |
| 3,085,329 | 4/1963 | Golczynski | 239/590.3 X |
| 3,128,160 | 4/1964 | Bascom | 34/82 |
| 3,980,238 | 9/1976 | Adiletta | 239/590.3 |
| 4,177,049 | 12/1979 | Haslett, Jr. | 55/487 X |

FOREIGN PATENT DOCUMENTS

| | | | |
|---|---|---|---|
| 390652 | 4/1933 | United Kingdom | 239/590.3 |

OTHER PUBLICATIONS

"Strainers and Straining Systems", Broughton Corp., Glen Falls, N.Y. Bulletin D3, Feb., 1967.

Perry, John H. *Chemical Engineers' Handbook,* 3rd ed. N.Y., McGraw Hill, 1950, p. 1172.

"Media and Fabricated Products for Solids-Liquid Separation", Multi-Metal Wire Cloth Inc., Tappan, N.Y., Bulletin No. 618R Nov., 1967.

*Primary Examiner*—Kathleen J. Prunner

[57] ABSTRACT

A filter for use inside tapered hot air nozzles positioned at spaced intervals along a feed line in a paint drying oven has an elongate cylindrical conduit formed of perforated stainless steel wrapped by stainless steel wire cloth having an absolute particle rating size of 80 microns. An open end of the conduit is connected to the nozzle port and a capped end extends into the nozzle feed line. A stainless steel adapter has a collar engaging the outer or inner surface of the nozzle adjacent the port and an integrally formed flange extending radially outwardly from the collar. A stainless steel retainer has a collar spot welded to the filter conduit adjacent the open end and an integrally formed flange extending radially outwardly from the collar and connected to the adapter flange by screws. A gasket is positioned between the flanges of the adapter and the retainer. Openings in the retainer flange have circular portions and slot portions extending in a uniform circumferential direction with respect to the flange to permit selective connecting and disconnecting of the adapter and retainer by relative rotation. An alternative filter has a galvanized wire mesh screen surrounding the wire cloth. The screen has longitudinal extensions which extend beyond the ends of the cloth and are rolled in against the conduit and welded thereto. An alternative retainer has a collar spot welded to the outer surface of a longitudinal extension of the conduit extending beyond the nozzle port.

1 Claim, 15 Drawing Figures

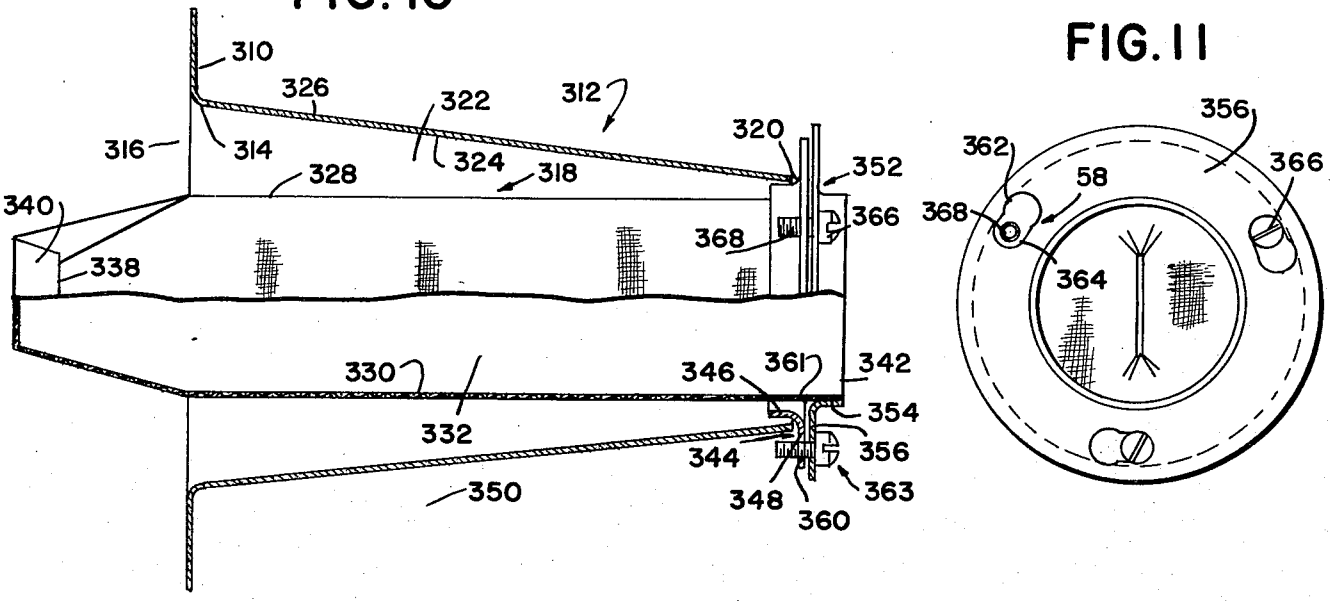
FIG. 10
FIG. 11
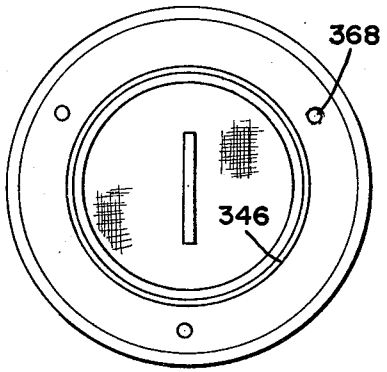
FIG. 12
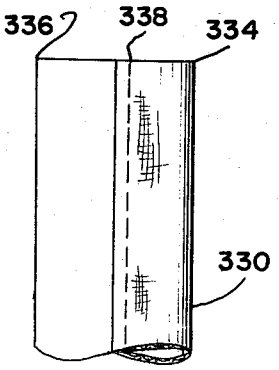
FIG. 13A
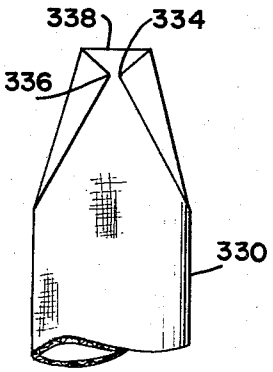
FIG. 13B
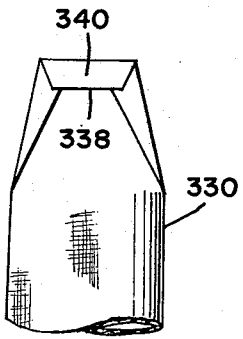
FIG. 13C

FILTER FOR HOT AIR NOZZLE

BACKGROUND OF THE INVENTION

This invention relates generally to filters and more particularly has reference to a filter for use inside hot air nozzles in a paint drying oven.

Examples of pertinent patents are U.S. Pat. Nos. 2,445,074; 1,211,325; 3,808,703; 3,877,107 and 2,448,834.

U.S. Pat. No. 2,445,074 discloses a spray booth used to paint a vehicle and quickly dry the paint by passing air through the booth. The air is passed through filter-containing doors in the booth to prevent blemishes on the newly painted car.

U.S. Pat. No. 1,211,325 shows a drying room with means for removing dust from air passed through the room. The air is cleaned by spraying it and then passing it through screen filters before it enters the room.

U.S. Pat. Nos. 3,808,703; 3,887,107 and 2,448,834 disclose automobile drying apparatus used for drying a car after a car wash.

None of the patents discloses a filter in a nozzle of a hot air blowing apparatus.

In conventional automobile paint drying ovens, hot air at approximately 500° is blown in a downward or sideways direction through nozzles to aid in drying a freshly painted car or vehicle. Known drying booths have approximately 500 nozzles. Each nozzle is about 6 inches in length and extends vertically downwardly from upper ceiling ductwork or inwardly from wall ductwork. The inlet of each nozzle is about 4 inches in diameter, tapering down to approximately 2¼ inches in diameter where the air actually leaves the nozzle and enters the oven environment. Each nozzle handles approximately 110 CFM per 2¼ inch opening at a pressure of approximately ½ inch. Hot air is expelled from each nozzle at a rate of approximately 3985 feet per minute.

A difficulty encountered in such drying booths is that the air tends to pick up any old rust and scale which accumulates on the inside of the ductwork. As the air is forced outward, small chips break loose and are carried by the air and become embedded in the newly painted vehicle. The vehicles then have to be resanded, repainted and redried, and it is very difficult to maintain quality control during those steps.

Attempts have been made to overcome the problem by attaching external filters on the exhaust side of the nozzle or by placing filters in the nozzle feed line. Neither attempt has proved satisfactory.

The nozzles are usually positioned on the feed line on 7 inch center holes. That close spacing between nozzles limits the size of the filter which can be used. External filters are generally large and require space consuming attachments, making them unsatisfactory for use with closely spaced nozzles and for access by maintenance people.

External filters also have an adverse effect on the air directional function of the nozzles.

Filters placed in the feed line have the disadvantage of being difficult to install and remove.

Yet another problem with the prior art filters is their inability to filter particles in the micron range without adversely restricting air flow through the nozzles.

SUMMARY OF THE INVENTION

The present invention overcomes many of the problems which exist in the prior art devices.

The invention uses a relatively non-complex filter in air nozzles that direct hot air downward or sideways in a paint drying booth. The filter is inserted into the nozzle from the open end for easy installation and removal and with minimal effect on the air directional function of the nozzle. It also avoids space consuming attachments.

The sizing and selection of the filter material achieves the particle size removal needed to eliminate the paint spotting problem and minimizes the air flow restriction. The material is also compatible with the 500° F. temperature encountered in the paint drying booth. A preferred filter uses a 180×180 mesh corrosion resistant screen with an absolute particle size rating of 80 microns.

The invention fixes an adapter ring on the nozzle outlet. A specific adapter ring has a collar which fits on the inside of the nozzle outlet and a flange which surrounds the nozzle outlet. The adapter ring is secured to the nozzle outlet by expanding or upsetting the collar or by welding the collar or flange to the nozzle or both or by some other fastening means. A cylindrical filter fits into the truncated conical nozzle body and may extend slightly into the distribution pipe. An annular gasket fits between the adapter ring flange and a flange of a retainer ring which has a collar which is connected to an open outlet end of the filter.

Objects of the invention are, therefore, to provide an improved filter and to provide an improved filter for use inside hot air nozzles in a paint drying oven.

Another object of the invention is to provide a non-complex filter for use in air nozzles that direct hot air downward or sideways in an automotive paint drying booth.

Still another object of the invention is to provide a filter which is easy to install and remove in a hot air nozzle.

Yet another object of the invention is to provide a filter which has a minimal effect on the air directional function of the nozzle.

Another object of the invention is to provide a nozzle which avoids space consuming attachments.

Still another object of the invention is to provide a filter which achieves the particle size removal necessary to eliminate the paint spotting problem in automotive paint drying booths while minimizing air flow restrictions.

Still another object of the invention is to provide a filter which is usable in an environment having a temperature of 500° F.

Still another object of the invention is to provide a filter which prevents rust and scale which breaks loose from the inside of the duct work from being embedded in the newly painted car.

Another object of the invention is to provide filter apparatus for use inside a nozzle comprising an elongate filter element having an exterior and an interior, an opening communicating with the interior, permeable surfaces providing communication between said exterior and said interior including filter media for filtering matter passing therethrough, and means for connecting the filter element to the nozzle in a position wherein the element extends into the interior of the nozzle and establishes communication between said opening and a nozzle port to filter matter passing through the nozzle.

Another object of the invention is to provide filter apparatus comprising filter media having an absolute particle size rating of about 80 microns.

Still another object of the invention is to provide filter media formed of stainless wire cloth material.

Another object of the invention is to provide connecting means comprising an adapter having a collar adapted to engage the nozzle adjacent the port and a flange extending radially outwardly from the collar and a retainer having a collar connected to the filter element adjacent the opening and a flange extending radially outwardly from the collar of the retainer.

Another object of the invention is to provide a retainer flange having a plurality of openings aligned with threaded openings formed in the adapter flange for receiving screws, said openings in the retainer flange having circular portions of diameter greater than the diameter of the heads of the screws and slot portions extending from these circular portions in a uniform circumferential direction with respect to the flange, said slot portions having widths less than the diameter of the heads of the screws, thereby permitting selective connecting and disconnecting of the retainer and adapter upon relative rotation thereof.

Another object of the invention is to provide fluid vent apparatus comprising a nozzle having a tapered annular side wall defining an open-ended passageway, an elongate filter element having an exterior and an interior, an opening communicating with the interior, permeable surfaces providing communication between said exterior and said interior including filter media for filtering matter passing therethrough, and means for connecting the filter element to the nozzle in a position wherein the element extends into the passageway in spaced relation to portions of the sidewall and establishes communication between said opening and an end of said passageway to filter matter passing through the nozzle, a source of pressurized fluid, a conduit connected to the source, and the end of the nozzle opposite the end of the passageway communicating with said opening and having an opening for communicating fluid from the source to the nozzle, said filter element extending into the conduit through said opening in the conduit.

Still another object is to provide filter apparatus for use inside a nozzle comprising an elongate filter element having an exterior and an interior, an opening communicating with the interior, rigid permeable surfaces providing communication between said exterior and said interior and filtering matter passing therethrough, and means for connecting the filter element to the nozzle in a position wherein the element extends into the interior of the nozzle and establishes communication between said opening and a nozzle port to filter matter passing through the nozzle.

A further object is to provide a filter element comprising an annular side wall defining an interior longitudinal conduit having an open end and a remote closed end, said wall being formed of rigid permeable material, and one end of the annular side wall being folded to provide said remote closed end.

These and other and further objects and features of the invention are apparent in the disclosure which includes the above and below specification and claims and drawings.

BRIEF DESCRIPTION OF THE DRAWINGS

FIG. 10 is a side elevational view, partly in section, of still another embodiment of the present invention.

FIG. 11 is an end view of the outward portion of the apparatus shown in FIG. 10.

FIG. 12 is an end view of the inward end of the apparatus shown in FIG. 10 removed from the nozzle.

FIGS. 13A–13C are side elevational views of the inward end of the apparatus shown in FIG. 10 at various stages of completion.

DETAILED DESCRIPTION OF THE DRAWINGS

The present invention is primarily directed to filters for use inside nozzles or other fluid vents.

Figure 1:
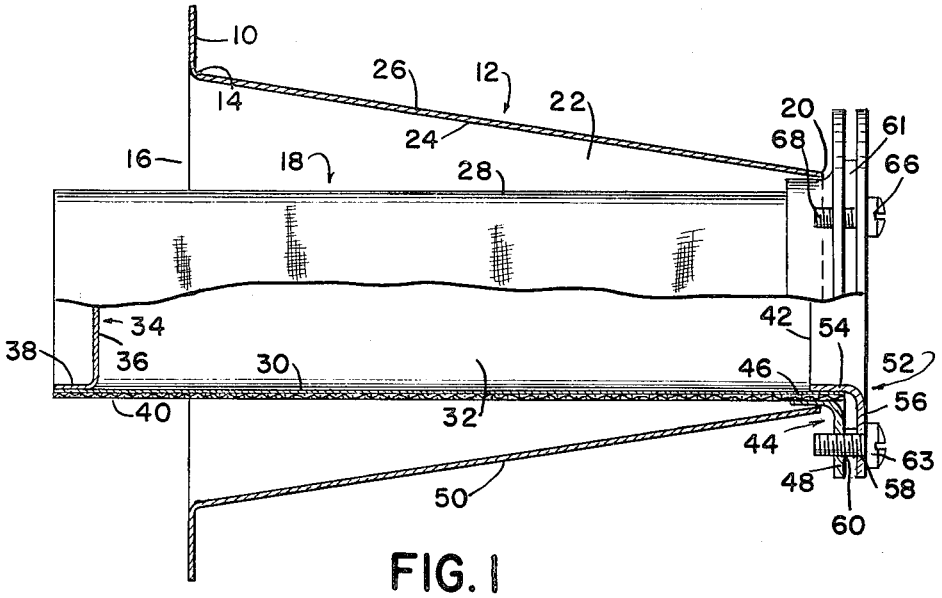
FIG. 1 is a side elevational view, partly in section, of filter apparatus embodying features of the present invention.

It has been found that the present invention is particularly useful with the hot air nozzles in automobile paint drying ovens. A distribution conduit is used to supply hot air to a drying booth. The booth has a plurality of nozzles connected to the conduit for exhausting the hot air into the booth. FIG. 1 shows a fragmentary portion of such a distribution conduit 10 and shows a typical hot air nozzle 12 connected to the conduit 10. The nozzle 12 has an open end 14 which is aligned with an opening 16 in the conduit 10 to permit communication of hot air from the conduit 10 to the interior of the nozzle 12.

Although the present invention will be discussed in connection with a hot air drying system, it is readily apparent that the filter apparatus of the present invention can be used in any system having a nozzle or a fluid vent. The invention is equally applicable to exhaust nozzles and intake nozzles. Moreover, the invention is applicable to the filtration of any fluid substance.

Referring again to FIG. 1, a filter embodying features of the present invention is indicated generally by the number 18. The filter 18 extends from the exhaust opening 20 of the nozzle 12 into the interior of the nozzle 12. Preferably, a portion of the filter 18 extends through the open end 14 and opening 16 into the distribution conduit 10. It is appreciated, however, that the present invention contemplates the use of filters of any length, including filters which extend through only a portion of the nozzle 12.

Figure 2:
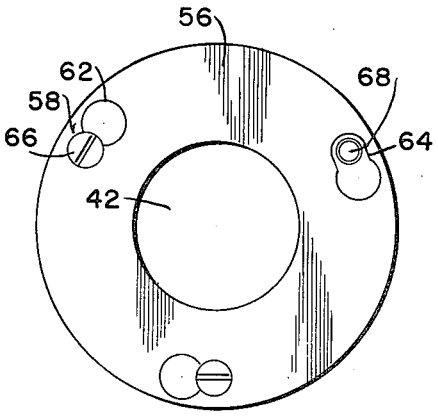
FIG. 2 is an end view of the outward portion of the filter apparatus shown in FIG. 1.
Figure 3:
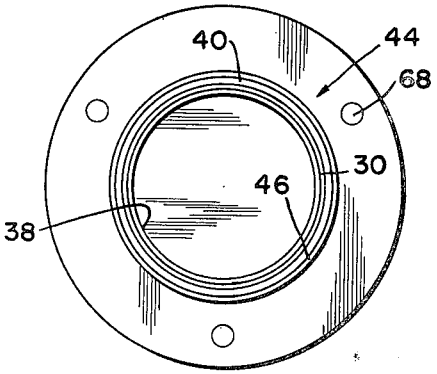
FIG. 3 is an end view of the inward end of the filter apparatus shown in FIG. 1 removed from the nozzle.

The nozzle 12 illustrated in FIG. 1 has a truncated conical shape. That shape is the one most frequently encountered in paint drying booths. The preferred filter 18 for use with such a nozzle 12 has a cylindrical shape, as best shown in FIGS. 2 and 3. This provides an annular space 22 between the inner surface 24 of the sidewall 26 of the nozzle 12 and the outer surface 28 of the filter 18, thereby permitting air to enter the nozzle 12 from the conduit 10 and impinge upon the outer surface 28 of the filter 18.

It is appreciated, however, that the shape of the nozzle and the shape of the filter can be varied without departing from the present invention. In addition to conical nozzles, square nozzles and rectangular nozzles are also known. The cylindrical filter 18 shown in the figures can be used with square or rectangular nozzles, or a filter having a different shape can be used.

The filter body 18 has a cylindrical inner screen 30 which defines a longitudinally extending passageway 32. The screen 30 can be formed of various materials and can have various constructions. The screen 30 should be sufficiently rigid to prevent compression of the filter 18 when used in the conventional out-to-in flow manner. The screen 30 must also be capable of withstanding the 500° F. temperatures normally encountered in drying ovens.

In one embodiment, the inner screen 30 can be a heavy wire mesh. In the preferred embodiment, the screen 30 is formed of perforated 24 gauge stainless steel having ⅛ inch holes on 3/16 inch centers. A stainless steel sheet can be formed into the required tubular shape by any conventional means such as butt welding or overlapping.

The inward end of the passageway 32 is closed by an inverted cap connected to the inward end of the inner screen 30. The cap 34 has a circular base 36 and an annular sidewall 38 extending axially from the radially outward edge of the base 36. The preferred cap 34 is formed of stainless steel and is spot welded to the inner screen 30 along the sidewall 38. It is understood, however, that the cap can have other shapes, can be formed of other materials, and can be connected to the inner screen by any conventional means.

The outer screen 40 of the filter 18 acts as the filter media. It has been found that the undesirable particles carried by the hot air in a drying oven generally have a size in the range of about 20–80 microns. Hence, any conventional filter media capable of removing particles of that size and capable of withstanding 500° F. temperatures can be used in the filter 18.

Preferably, the outer screen 40 is formed of 180×180×0.0023 stainless steel wire cloth. As is well known in the art, the first two numbers indicate the number of horizontal and vertical wire strands per inch and the third number indicates the diameter of the wire strands. The preferred material is compatible with 500° F. temperatures, is corrosion resistant, and has absolute particle size rating of about 80 microns.

It is understood that the outer screen 40 can be applied to the inner screen 30 in any conventional manner and in various thicknesses. Preferably, a single layer of the outer screen material is wrapped onto the inner screen 30 and spot welded. More than one layer of screen material can be applied, if desired.

It can now be readily understood that particulate-laden air entering the nozzle 12 from the conduit 10 flows into the annular space 22, passes through the outer screen 40 which removes the particulate matter, and then passes through the permeable inner screen 30 into the passageway 32. The filtered air flows through the passageway 32 and is exhausted into the drying booth through the open end 42 of the passageway 32 and the exhaust opening 20 of the nozzle 12.

The preferred means for connecting the filter 18 to the nozzle 12 is best shown in FIGS. 2 and 3.

An adapter ring 44 comprises an L-flange having a collar 46 which fits inside the nozzle outlet and an annular flange 48 which extends radially outwardly from the end of the collar 46. The collar 46 is secured to the nozzle 12 by any conventional means, such as by expanding or upsetting the collar 46 or by welding the collar 46 to the nozzle 12 or by some other fastening means. Preferably, the collar 46 is spot welded to the nozzle 12. It is understood that the nozzle 12 will generally be formed of galvanized material.

In an alternative embodiment, the collar of the adapter ring is fit outside the nozzle outlet and is secured to the outer surface 25 of the nozzle. With that configuration, the outer surface of the filter abuts the inner surface of the nozzle adjacent the opening to prevent unfiltered air from being exhausted from the annular space between the nozzle and filter.

A retainer ring 52 comprises an L-flange having a collar 54 which fits inside the open end 42 of the filter 18 and an annular flange 56 which extends radially outwardly from the end of the collar 54 in a direction generally parallel to the direction of the adapter flange 48. The retainer collar 54 is connected to the inner screen 30 of the filter 18 by any conventional means, preferably by spot welding.

The retainer flange 56 is provided with openings 58 which are aligned with threaded openings 60 formed in the adapter flange 48. Preferably, three sets of aligned openings 58 and 60 are provided at equidistant intervals around the flanges 48 and 56. Screws 63 project through the opening 58 in the retainer flange 56 and matingly engage the screw threads in the openings 60 in the adapter flange 48. The distance between the flanges 48 and 56 is adjusted by tightening or loosening the screws 63.

The adapter 44 and retainer 52 can be formed of any rigid material compatible with a drying booth environment. Preferably, the adapter 44 and retainer 52 are formed of 13 gauge and 16 gauge stainless steel respectively. It is also preferred that the respective collars and flanges of the adapter 44 and retainer 56 be formed integrally, but it is understood that they can be formed separately.

A gasket 61 is positioned between the adapter flange 48 and the retainer flange 56. The gasket can be formed of any conventional gasket material.

As shown in FIG. 2, the openings 58 in the retainer flange 56 have circular portions 62 and slot portions 64 extending from the circular portions in a uniform circumferential direction with respect to flange 56. The circular portions 62 have a diameter greater than the diameter of the screw heads 66. The slot portions 64 have a width which is less than the diameter of the screw heads 66 and slightly greater than the diameter of the threaded shafts or stems 68. Hence, the retainer 52 can be disconnected from the adapter 44 by rotating either the adapter 44 or retainer 52 to a position wherein the openings 60 in the adapter flange 48 are aligned with the circular portions 62 of the openings 58 in the retainer flange 56. Similarly, the retainer 52 can be connected to the adapter 44 when the adapter 44 and retainer 52 are in that alignment without removing the screws 63 from the openings 60 in the adapter flange 48. After the retainer 52 is connected to the adapter 44, the adapter 44 or retainer 52 can be rotated to align the openings 60 in the adapter flange with the slot portions 64 of the openings 58 in the retainer flange 56 to prevent disconnecting of the retainer 52 and adapter 44.

A technique for connecting the filter 18 to the nozzle 12 can now be readily understood.

In a typical drying booth, the nozzles 12 have a length of about 6 inches, the inward end 14 of the nozzle has an outside diameter of about 4 inches, the exhaust opening 20 of the nozzle 12 has an outside diameter of about 2¼ inches, and the nozzles 12 are positioned on the conduit 10 at about 7 inch centers. A compatible filter 18 has a length of about 7½ inches and an outside diameter of about 2⅛ inches. The inside diameter of the retainer collar 54 is about 1.6 inches and the outside diameter of the retainer flange 56 is about 3.38 inches. Those dimensions can be varied without departing from the present invention.

The filter 18 is inserted into the nozzle 12 through the exhaust opening 20 until the outward end of the nozzle 12 abuts the gasket 61. If the screws 63 are already threaded into the openings 60 in the adapter flange 48, the retainer 52 must be rotated relative to the nozzle 12 to align the screw heads 66 with the circular portions 62 of the openings 58 in the retainer flange 56. The retainer flange is then fit over the screw heads 66 and is rotated relative to the nozzle 12 so that the screw heads 66 are aligned with the slot portions 64 of the openings 58 in the retainer flange 56 to hold the filter 18 within the nozzle 12. The screws 63 are tightened to secure the assembly. If, on the other hand, the screws 63 have not been threaded into the openings 60 in the adapter flange 48, the openings 60 can be immediately aligned with the slot portions 64 and the screw stems can be projected through the slot portions and threaded into the openings 60 while the gasket 61 is held in abutment against the outward end of the nozzle 12. The screws 63 are then tightened to secure the assembly.

If it becomes necessary to replace, repair or inspect the filter 18, the screws 63 are loosened slightly and the retainer 52 is rotated relative to the nozzle 12 to align the screw heads 66 with the circular portions 62 of the openings 58 in the retainer flange 56. The retainer 52 is passed over the screw heads 66, withdrawing the filter 18 from the nozzle 12.

Re-assembly is accomplished in the manner previously described.

Figure 4:
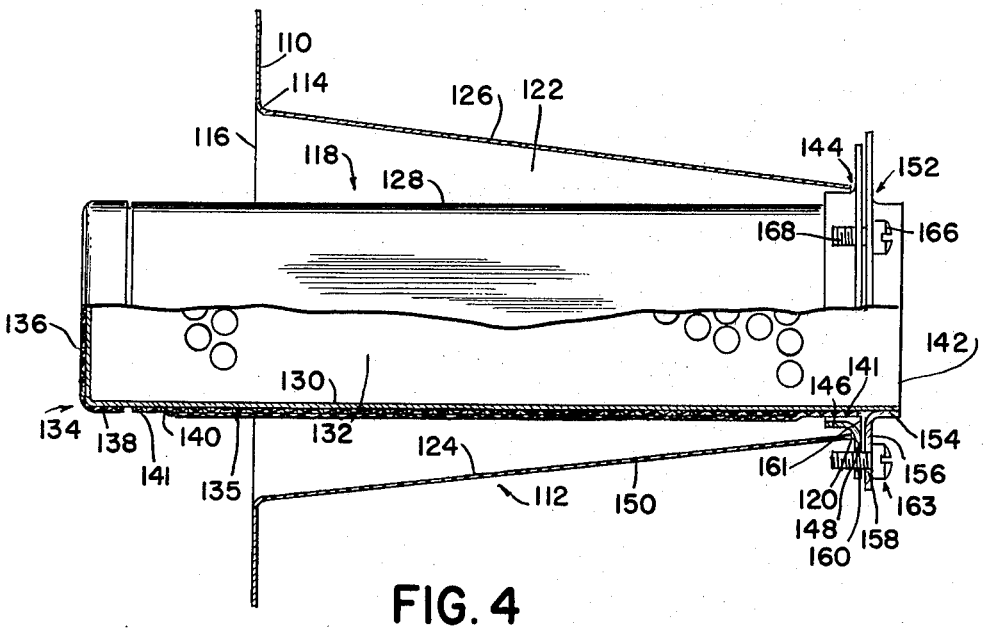
FIG. 4 is a side elevational view, partly in section, of another embodiment of the present invention.
Figure 5:
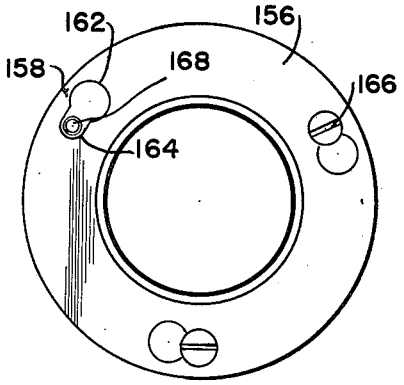
FIG. 5 is an end view of the outward portion of the apparatus shown in FIG. 4.
Figure 6:
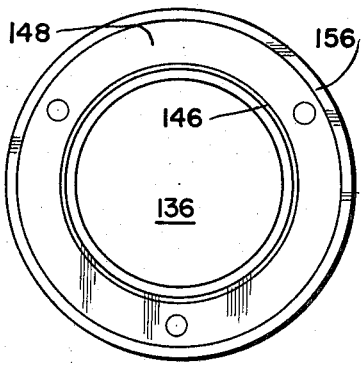
FIG. 6 is an end view of the inward end of the apparatus shown in FIG. 4 removed from the nozzle.

An alternative filter apparatus embodying features of the present invention is shown in FIGS. 4–6.

The distribution conduit 110 and hot air nozzle 112, shown in FIG. 4, are substantially identical to the corresponding elements shown in FIG. 1. The nozzle 112 has an inward open end 114 which is aligned with an opening 116 in the conduit 110 to permit communication of hot air from the conduit 110 to the interior of the nozzle 112.

The filter apparatus is indicated generally by the number 118. The filter extends from the exhaust opening 120 of the nozzle 112 into the interior of the nozzle 112. Preferably, a portion of the filter 118 extends through the open end 114 and opening 116 into the distribution conduit 110.

The filter 118 has a cylindrical shape to provide an annular space 122 between the inner surface 124 of the truncated conical sidewall 126 of the nozzle 112 and the outer surface 128 of the filter 118, thereby permitting air to enter the nozzle 112 from the conduit 110 and impinge upon the outer surface 128 of the filter 118.

The filter 118 has a cylindrical tubular element 130 which defines a longitudinally extending passageway 132. The element 130 can be formed of various materials and can have various constructions. It should be sufficiently rigid to prevent compression of the filter 118 when used in the conventional out-to-in flow manner. It must also be capable of withstanding the 500° F. temperatures normally encountered in drying ovens.

In the preferred embodiment, the tubular element 130 is formed of perforated 24 gauge steel having perforations of 0.25" diameters on 0.31" staggered center lines. A perforated steel sheet can be formed into the required tubular shape by any conventional means, such as butt welding, seam welding, or overlapping.

The inward end of the passageway 132 is closed by a cap 134 connected to a longitudinal extension of the tubular element 130. The cap 134 has a circular top 136 and an annular sidewall 138 extending axially from the radially outward edge of the top 136. The preferred cap 134 is formed of 24–28 steel and is spot welded to the outer surface of the longitudinal extension of the tubular element 130 along the sidewall 138.

The passageway 132 has an open outward end 142.

An inner screen 135 acts as the filter media. Preferably, the inner screen 135 is formed of 180×180 mesh×0.0023 stainless steel wire. The inner screen 135 can be applied to the tubular element 130 in any conventional manner and in various thicknesses. Preferably, a single layer of the inner screen material 135 is wrapped onto the tubular element 130. More than one layer of screen material can be applied if desired.

The inner screen 135 terminates longitudinally at locations spaced from both the inward and outward ends of the tubular element.

An outer screen 140 surrounds the inner screen 135. The outer screen 140 has longitudinal extensions 141 which extend beyond the ends of the inner screen 135. The extensions 141 are rolled in against the tubular element 130 and connected thereto by any conventional means, such as spot welding.

The outer screen 140 can be formed of a variety of materials. Preferably, the outer screen 140 is formed of 30×30 mesh×0.011 galvanized steel wire.

The outer screen 140 insures that the inner screen 135 is properly positioned on the tubular element 130. In addition, the outer screen 140 prevents rust or other particulate matter, carried by the hot air, from coming into contact with or damaging the fine inner screen material.

The end of the inward longitudinal extension 141 of the outer screen 140 is spaced slightly from the end of the annular sidewall 138 of the cap 134 to permit removal, replacement, or adjustment of the cap 134 without interfering with the outer screen 140 or inner screen 135.

The preferred means for connecting the filter 118 to the nozzle 112 is best shown in FIGS. 4 and 5.

The adapter ring 144 is substantially identical to the adapter ring 44 shown in FIG. 1. It comprises an L-flange having a collar 146 which fits inside the nozzle outlet and an annular flange 148 which extends radially outwardly from the end of the collar 146. The collar 146 is secured to the nozzle 112 by any conventional means, such as by expanding or upsetting the collar 146 or by welding the collar 146 to the nozzle 112, or by some other fastening means. Preferably, the collar 146 is spot welded to the nozzle 112.

Alternatively, the collar of the adapter ring is fit outside the nozzle outlet and is secured to the outer surface 125 of the nozzle.

A retainer ring 152 comprises an L-flange having a collar 154 which extends along the outside surface of a longitudinal extension of the tubular element 130. An annular flange 156 extends radially outwardly from the inward end of the collar 154 in a direction generally parallel to the direction of the adapter flange 148. The retainer collar 154 is connected to the outer surface of the tubular element 130 by any conventional means, preferably by spot welding.

The retainer flange 156 is provided with openings 158 which are aligned with threaded openings 160 formed in the adapter flange 148. Preferably, three sets of aligned openings 158 and 160 are provided at equal distant intervals around the flanges 148 and 156. Screws 163 project through the opening 158 in the retainer flange 156 and matingly engage the screw threads in the openings 160 in the adapter flange 148. The distance between the flanges 148 and 156 is adjusted by tightening or loosening the screws 163.

The adapter 144 and retainer 152 can be formed of any rigid material compatible with a drying booth environment. Preferably, the adapter 144 and retainer 152 are formed of 16 gauge steel. It is preferred that the respective collars and flanges of the adapter 144 and retainer 152 be formed integrally, but it is understood that they can be formed separately.

A gasket 161 is positioned between the adapter flange 148 and the retainer flange 156. The gasket can be formed of any conventional gasket material.

As shown in FIG. 5, the openings 158 in the retainer flange 156 have circular portions 162 and slot portions 164 extending from the circular portions 162 in a uniform circumferential direction with respect to the flange 156. The circular portions 162 have a diameter greater than the diameter of the screw heads 166. The slot portions 164 have a width which is less than the diameter of the screw heads 166 and slightly greater than the diameter of the threaded stems 168. Hence, the retainer 152 can be connected and disconnected to the adapter 144 in the same manner described with respect to the retainer 52 and adapter 44 shown in FIG. 2.

The retainer 152 shown in FIG. 4 has several advantages over the retainer 52, shown in FIG. 1. Because the retainer 152 is connected to the outer surface of the tubular element 130, it does not enter the passageway 132 and does not interfere with flow in the passageway. The retainer 52 restricts the filter exhaust opening by an amount equal to twice the thickness of the retainer material. Moreover, the inward edge of the retainer collar 54 may tend to create flow turbulence near the exhaust outlet.

On the other hand, the retainer 52, shown in FIG. 1, has advantages over the retainer 152, shown in FIG. 4. In particular, the retainer 52 provides a more compact connecting means and substantially avoids longitudinal extensions beyond the exhaust opening 20 of the nozzle 12.

A filter 118 compatible with the typical drying booth nozzle described earlier has a length of about 9" as measured from the top 136 of the cap 134 to the inward surface of the retainer 152. The retainer flange 156 has an outside diameter of about 3.62" and the adapter flange 148 has an outside diameter of about 3.38". The retainer collar 154 has an outside diameter of about 2.12" and the adapter collar 146 has an outside diameter of about 2.38". Preferably, the perforations on the tubular element 130 begin about 1" from the inward end of the element 130 and terminate about 1" from the outward end of the element 130. Those dimensions can be varied without departing from the present invention.

The filter 118 is inserted into the nozzle 112 and secured thereto in a manner identical to that described with respect to the filter 18 and nozzle 12.

The disassembly and reassembly proceed in the manner identical to that described with respect to the filter 18 and nozzle 12.

Two further embodiments of the present invention are shown in FIGS. 7–13. These embodiments are lower cost versions of the present invention, where the mesh screen material, through proper selection, is of sufficient structural strength to support itself in operation.

Figure 7:
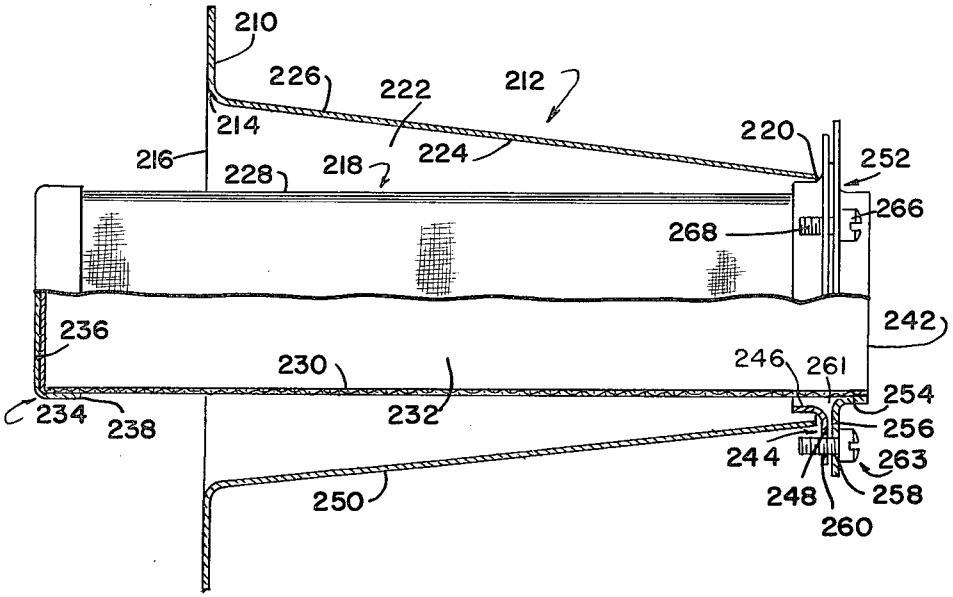
FIG. 7 is a side elevational view, partly in section, of yet another embodiment of the present invention.
Figure 9:
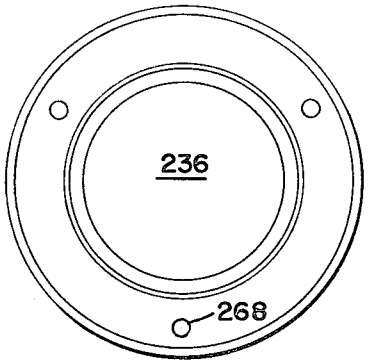
FIG. 9 is an end view of the inward end of the filter apparatus shown in FIG. 7 removed from the nozzle.

Referring to FIG. 7, the distribution conduit 210 and hot air nozzle 212 are substantially identical to the corresponding elements shown in FIGS. 1 and 4. The nozzle 212 has an inward open end 214 which is aligned with an opening 216 in the conduit 210 to permit communication of hot air from the conduit 210 to the interior of the nozzle 212.

The filter apparatus of this embodiment is indicated generally by the number 218. The filter extends from the exhaust opening 220 of the nozzle 212 into the interior of the nozzle 212. Preferably, a portion of the filter 218 extends through the open end 214 and opening 216 into the distribution conduit 210. It is appreciated, however, that the present invention contemplates the use of filters of any length, including filters which extend only through a portion of the nozzle 212.

The filter 218 has a cylindrical shape to provide an annular space 222 between the inner surface 224 of the truncated conical sidewall 226 of the nozzle 212 and the outer surface 228 of the filter 218, thereby permitting air to enter the nozzle 212 from the conduit 210 and impinge upon the outer surface 228 of the filter 218.

The filter 218 has a cylindrical element 230 which defines a longitudinally extending passageway 232. The element 230 can be formed of any material which is sufficiently rigid to be self supporting and to be capable of maintaining the cylindrical shape in operation. It should be sufficiently rigid to prevent compression of the filter 218 when used in the conventional out-to-inflow manner. It must also be capable of withstanding the 500° F. temperatures normally encountered in drying ovens.

In addition, the element 230 must be formed of material which is capable of acting as the filter media. As previously noted, the filter media should be capable of removing particles having a size in the range of about 20–80 microns.

In the preferred embodiment, the element 230 is formed of mesh screen material. Two screen materials which have been found particularly suitable for use in the present invention are 60–80 mesh stainless steel wire with a diameter in the range of about 0.007–0.011 inches and 175×50 reverse Dutch weave stainless steel wire with a diameter in the range of about 0.006–0.012 inches.

The screen material can be formed into the required cylindrical shape by any conventional means, such as butt welding, seam welding, overlapping, or wrapping about a mandrel. Preferably, the element 230 is formed of a single layer or thickness of the screen material. However, the element 230 can be formed of plural layers or thickness of screen material if desired.

The inward end of the passageway 232 is closed by a cap 234 connected to the end of the cylindrical element 230. The cap 234 has a circular top 236 and an annular side wall 238 extending axially from the radially outward edge of the top 236. The preferred cap 234 is formed of steel and is spot welded to the outer surface of the cylindrical element 230 along the sidewall 238.

The passageway 232 has an open outward end 242.

Figure 8:
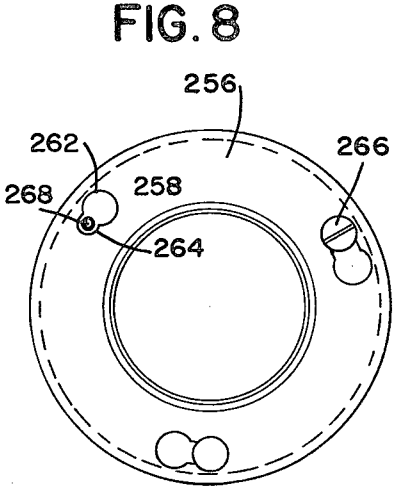
FIG. 8 is an end view of the outward portion of the filter apparatus shown in FIG. 7.

The preferred means for connecting the filter 218 to the nozzle 212 is best shown in FIGS. 7 and 8. It will be recognized that the connecting means is substantially identical to the connecting means shown in FIG. 4.

The adapter ring 244 is identical to the adapter rings 44 and 144, shown in FIGS. 1 and 4. It comprises an L-flange having a collar 246 which fits inside the nozzle outlet 220 and an annular flange 248 which extends radially outwardly from the end of the collar 246. The collar 246 is secured to the nozzle 212 by any conventional means, such as by expanding or upsetting the collar 246, or by welding the collar 246 to the nozzle 212, or by some other fastening means. Preferably, the collar 246 is spot welded to the nozzle 212.

Alternatively, the collar 246 is fit outside the nozzle outlet 220 and is secured to the outer surface 225 of the nozzle 212.

The retainer ring 252 is identical to the retainer ring 152 as shown in FIG. 4. It comprises an L-flange having a collar 254 which extends along the outer surface of the cylindrical element 230 at the open end 242 thereof. An annular flange 256 extends radially outwardly from the inward end of the collar 254 in a direction generally parallel to the direction of the adapter flange 248. The retainer collar 254 is connected to the outer surface of the cylindrical element 230 by any conventional means, preferably by spot welding.

The retainer flange 256 is provided with openings 258 which are aligned with threaded openings 260 formed in the adapter flange 248. Preferably, three sets of aligned openings 258 and 260 are provided at equidistant intervals around the flanges 248 and 256. Screws 263 project through the opening 258 in the retainer flange 256 and matingly engage the screw threads in the openings 260 in the adapter flange 248. The distance between the flanges 248 and 256 is adjusted by tightening oor loosening the screws 263.

The adapter 244 and retainer 252 can be formed of any rigid material compatible with a drying booth environment. Preferably, the adapter 244 and retainer 252 are formed of 16 gauge steel. It is preferred that the respective collars and flanges of the adapter 244 and retainer 256 can be formed integrally, but it is understood that they can be formed separately.

A gasket 261 is positioned between the adapter flange and the retainer flange 256. The gasket can be formed of any conventional gasket material compatible with a drying booth environment.

As shown in FIG. 8, the openings 258 in the retainer flange 256 have circular portions 262 and slot portions 264 extending from the circular portions 262 in a uniform circumferential direction with respect to the flange 256. The circular portions 262 have a diameter greater than the diameter of the screw heads 266. The slot portion 264 have a width which is less than the diameter of the screw heads 266 and slightly greater than the diameter of the threaded stems 268. Hence, the retainer 252 can be connected and is connected to the adapter 244 in the same manner described with respect to the retainer 152 and adapter 144 shown in FIG. 4.

A filter 218, compatible with the typical drying booth nozzle described earlier, has a length of about 9 inches as measured from the top 236 of the cap 234 to the inward surface of the retainer 252. The retainer flange 256 has an outside diameter of about 3.62 inches and the adapter flange 248 has an outside diameter of about 3.38 inches. The retainer collar 254 has an ouside diameter of about 2.12 inches and the adapter collar 246 has an outside diameter of about 2.38 inches. The adapter 244 and retainer 252 both have an axial length of about 0.38 inches. Those dimensions can be varied without departing from the present invention.

The filter 218 is inserted into the nozzle 212 and secured thereto in a manner identical to that described with respect to the filter 118 and nozzle 112. Disassembly and reassembly proceed in the manner identical to that described with respect to the filter 118 and nozzle 112.

Still another alternative filter apparatus embodying features of the present invention is shown in FIGS. 10–13.

The distribution conduit 310 and hot air nozzle 312 are identical to the corresponding elements shown in FIG. 7. The nozzle 312 has an inward open end 314 which is aligned with an opening 316 in the conduit 310 to permit communication of hot air from the conduit 310 to the interior of the nozzle 312.

The filter apparatus is indicated generally by the number 318. The filter extends from the exhaust opening 320 of the nozzle 312 into the interior of the nozzle 312. Preferably, a portion of the filter 318 extends through the open end 314 and opening 316 into the distribution conduit 310.

The filter 318 has a cylindrical shape to provide an annular space 322 between the inner surface 324 of the truncated conical sidewall 326 of the nozzle 312 and the outer surface 328 of the filter 318, thereby permitting air to enter the nozzle 312 from the conduit 310 and impinge upon the outer surface 328 of the filter 318.

The filter has a cylindrical element 330 which defines a longitudinally extending passageway 332. The element 330 can be formed of any material which is sufficiently rigid to be self-supporting and to be capable of maintaining the cylindrical shape in operation. It should be sufficiently rigid to prevent compression of the filter 318 when used in the conventional out-to-in flow manner. It must also be capable of withstanding the 500° F. temperatures normally encountered in drying ovens.

In addition, the cylindrical element 330 must be formed of material capable of acting as the filter media.

Preferably, the cylindrical element 330 is formed of materials which are identical to the materials used to form the cylindrical element 230 shown in FIG. 7. It is further preferred that the materials be formed into the required cylindrical shape by the same means used to correspondingly form the cylindrical element 230 and that the cylindrical element 330 be formed of the same number of thicknesses of material as the cylindrical element 230.

The passageway 332 has an open outward end 342. The inward end of the passageway 332 is closed by folding the end of the cylindrical element 330. It is contemplated that the cylindrical element 330 can be folded in any manner which will completely close the end of the passageway 332.

The preferred manner of folding the end of the element 330 is shown in FIGS. 13A–13C. Those figures illustrate a three step folding process.

The inward end of the cylindrical element 330 is initially flattened as shown in FIG. 13A. The flattening can be carried out in any conventional manner such as by pressing or rolling.

As shown in FIG. 13B, the corners 334 and 336 of the flattened end are folded radially and axially inwardly. Preferably, the folded corners 334 and 336 are spaced slightly apart and are equidistant from the axis of the cylindrical element 330.

The edge 338 of the flattened portion is then folded inwardly about an axis transverse to the longitudinal axis of the cylindrical element 330 as shown in FIG. 13C. Preferably, the folding axis is sufficiently spaced from the edge 338 so that the folded portion 340 adjacent the edge 338 overlaps the folded corners 334 and 336. The folded portion 340 is then secured in position by spot welding or by some other conventional means.

The folding steps shown in FIGS. 13B and 13C can be carried out in any conventional manner.

Preferably, the folding axis for the corners 334 and 336 extends diagonally from a radially inward portion of the edge 338 to the outer surface 328 of the cylindrical element 330 adjacent the open end 314 of the nozzle 312. By folding the end of the cylindrical element 330 in that manner, the folded portion is entirely outside of the nozzle 312, as shown in FIG. 10. It is understood, however, that other folding axes or folding procedures can be used without departing from the present invention.

The preferred means for connecting the filter 318 to the nozzle 312 is best shown in FIGS. 10 and 11. It will be readily apparent that the connecting means is identical to the connecting means shown in the FIGS. 7–8. Hence, a detailed description of the connecting means is unnecessary. For convenience, the various elements of the connecting means 344–368 have been designated by reference numbers which are 100 higher than the reference numbers used to designate the corresponding elements of the connecting means 244–268 shown in FIGS. 7 and 8.

A filter 318 compatible with the typical drying booth nozzle described earlier has dimensions which are identical to the dimensions specified above for the filter 218. Again, those dimensions can be varied without departing from the present invention.

The filter 318 is inserted into the nozzle 312 and secured thereto in a manner identical to that described with respect to the filter 218 and nozzle 212. Disassembly and reassembly also proceed in an identical manner.

While the invention has been described with reference to a specific embodiment, the exact nature and scope of the invention is defined in the following claims.

What is claimed is:

1. In a nozzle having a nozzle interior and a nozzle port, the improvement comprising filter apparatus for use inside the nozzle, said filter apparatus comprising an elongate filter element having an exterior and an interior, an opening communicating with the interior, and permeable surfaces providing communication between said exterior and said interior including filter medium for filtering matter passing therethrough, and means for connecting the filter element to the nozzle in a position wherein the element extends into the interior of the nozzle and establishes communication between said opening and the nozzle port to filter matter passing through the nozzle, said connecting means comprising an adapter having a collar engaging the nozzle adjacent the port and having a flange extending radially outwardly from the collar, a retainer having a collar connected to the filter element adjacent the opening and having a flange extending radially outwardly from the collar of the retainer for mounting on the adapter flange, said retainer flange being selectively connectable to and disconnectable from the adapter flange, the retainer flange being provided with a plurality of circumferentially spaced openings aligned with threaded openings formed in the adapter flange, said threaded openings receiving threaded shafts of screws provided for selectively connecting the retainer flange to the adapter flange, said openings in the retainer flange having circular portions of diameter greater than the diameter of heads of the screws and having slot portions extending from the circular portions in a uniform circumferential direction with respect to the flange, said slot portions having widths less than the diameter of the heads of the screws, thereby permitting free relative axial movement of the retainer flange and adapter flange upon relative rotation thereof in a direction to align the screw heads with the circular portions and restricting relative axial movement of the retainer flange and adapter flange upon projecting the screw heads through the circular portions and relatively rotating the retainer flange and adapter flange in a direction to align the screw heads with the slot portions.

* * * * *